United States Patent [19]

DeBoer et al.

[11] Patent Number: 4,705,269

[45] Date of Patent: Nov. 10, 1987

[54] EXERCISE APPARATUS

[75] Inventors: William M. DeBoer, P.O. Box 17262, Pittsburgh, Pa. 15235; Stanley E. DeBoer, Jr., 3619 McCrady Rd., Pittsburgh, Pa. 15235; Robert C. Hykes, Turtle Creek, Pa.

[73] Assignees: William M. DeBoer, Pittsburgh; Stanley E. DeBoer, Jr., Pittsburgh, both of Pa.

[21] Appl. No.: 791,477

[22] Filed: Oct. 25, 1985

[51] Int. Cl.[4] ..... A63B 21/00; A61H 1/02

[52] U.S. Cl. ..... 272/73; 128/25 R; 280/232

[58] Field of Search ..... 272/73; 128/25 R, 707; 280/224, 225, 232, 233, 261

[56] References Cited

U.S. PATENT DOCUMENTS

| | | | |
|---|---|---|---|
| 336,226 | 2/1886 | Funk | 280/233 |
| 3,193,305 | 7/1965 | Hendricks | 280/225 |
| 3,213,852 | 10/1965 | Zent . | |
| 3,572,699 | 3/1971 | Nies | 272/73 |
| 3,964,742 | 6/1976 | Carnielli . | |
| 4,071,235 | 1/1978 | Zent . | |
| 4,188,030 | 2/1980 | Hooper . | |
| 4,257,588 | 3/1981 | Ketchman | 272/73 |
| 4,502,705 | 3/1985 | Weaver | 280/261 |
| 4,521,012 | 6/1985 | Cosby et al. | 272/73 |

OTHER PUBLICATIONS

1985 Bicycle Buyer's Guide, Jun./Jul. 1985, Home Gym & Fitness, pp. 62–69.

*Primary Examiner*—Richard J. Apley
*Assistant Examiner*—S. R. Crow
*Attorney, Agent, or Firm*—Kirkpatrick & Lockhart

[57] ABSTRACT

An exercise apparatus including upper and lower body exercising assemblies which are operable in isolation or in conjunction with each other. The upper body assembly includes rotary handle members which rotate a driving sprocket. The upper driving sprocket in turn rotates an upper driven sprocket which is connected via two additional sprockets and an endless chain to the wheel of the lower body exercising assembly. The lower body assembly is a conventional exercise bicycle including rotary foot pedals for rotating a lower driving sprocket which in turn rotates a lower driven sprocket connected to the wheel. The upper and lower driven sprockets are one-directional ratcheted sprockets which can be rotated only by the endless chain joining them to the upper and lower driving sprockets, respectively, to provide the independent operation of the upper and lower body exercising assemblies.

25 Claims, 2 Drawing Figures

EXERCISE APPARATUS

BACKGROUND OF THE INVENTION

1. Field of the Invention

The present invention relates to exercise apparatus and, more particularly, to upper and lower body exercise apparatus.

2. Description of the Prior Art

Stationary exercise cycles resembling modified bicycles are well-known. The most common variety of exercise cycle exercises only the lower body. Medical evidence indicates, however, that upper body exercise increases heart rate and energy expenditure to a greater degree than lower body exercise. Exercising both the upper and lower body produces the best overall results because the work is spread over a large muscle mass, thereby moderating the rise in blood pressure.

Several exercise cycles are commercially available which offer both upper and lower body exercise. For example, the Schwinn® Air-Dyne™ has moving hand levers in combination with the traditional rotary foot pedals to exercise both the upper and lower body. The upper and lower body can be exercised independently with the Air-Dyne™ by removing either the hands or the feet from the respective levers or pedals and only utilizing one portion of the apparatus. The unused portion continues to move, however, because the hand levers are operatively connected to the foot pedals through the wheel hub. A similar cycle is described in Hooper U.S. Pat. No. 4,188,030 which issued on Feb. 12, 1980.

The American Sports, Inc.'s Rowing Sports-Cycle also features a lever type upper body exercising device in combination with a traditional pedal type exercise cycle.

The back and forth motion required by lever or rowing type upper body exercising devices is not as smooth a motion as the circular pedaling motion. At the end of each stroke, the user must change the direction of force and consequently, experiences a momentary change of acceleration. When tension is applied to the workload, the change in direction places a strain on the shoulder muscles.

Zent U.S. Pat. No. 4,071,235, which issued on Jan. 31, 1978 and Niles U.S. Pat. No. 3,572,699, which issued on March 30, 1971, each describe an exercise apparatus having a rotary foot and hand operated pedals to provide lower and upper body exercise. The foot and hand pedals are operatively connected by chains so that an unused portion will not remain stationary while the other portion is in use. Thus, if the upper body portion alone is being used, the foot pedals continue to rotate. If the person exercising on the apparatus doesn't want to passively exercise his lower body, he must awkwardly hold his legs away from the rotating pedals or risk injury.

Exercise cycles equipped with motors for passive upper and lower body exercise are described in Zent U.S. Pat. No. 3,213,852, issued on Oct. 26, 1965 and Carnielli U.S. Pat. No. 3,964,742, issued on June 22, 1976.

Ketchum U.S. Pat. No. 4,257,588, which issued on Mar. 24, 1981, describes a crank type upper body exerciser attachment for traditional exercise cycles. The upper body portion is not so operatively connected to the lower body portion that the two cannot be used independently without actuating the unused portion.

However, the upper body attachment does not drive the wheel of the cycle. The wheel generally absorbs the rotational energy transmitted from the hand and/or foot pedals. Distance equivalents can be monitored by monitoring the rotating of the wheel. In the Ketchum exerciser there is no common resistance to rotation for the foot and hand cranks thus making it difficult to monitor distance.

There is a need for an exercise apparatus, which permits upper and lower body exercise to be performed simultaneously or independently, at the users option, without the hazard and inconvenience of the continued operation of an unused portion. There is a further need for such an apparatus which promotes a smooth upper body motion and offers common resistance to the foot and hand operated portions so that distance equivalents can be easily monitored.

SUMMARY OF THE INVENTION

The present invention provides an exercise apparatus which permits upper and lower body exercise to be performed independently or in conjunction, at the user's option. The exercise apparatus may be a single unit comprising upper and lower body exercising assemblies or may be an upper body exercising assembly adapted for attachment to and use with a lower body exercising assembly, such as a stationary exercise bicycle.

The lower body exercise assembly includes a frame, a lower driving sprocket, means, such as rotary foot pedals, for rotating the lower driving sprocket, a lower driven sprocket operatively connected to the lower driving sprocket for rotation therewith, means, such as an endless chain, for operatively connecting the lower driving and driven sprockets, and means, such as a wheel, for receiving energy from the rotation of said lower driven sprocket.

The upper body exercise assembly includes an upper driving sprocket, means, such as rotary hand members, for rotating the upper driving sprocket, an upper driven sprocket operatively connected to the upper driving sprocket for rotation therewith, means, such as an endless chain, for operatively connecting the upper driving and driven sprockets, means for connecting the upper driven sprocket to the energy receiving means so that the energy receiving means receives energy from the rotation of the upper driven sprocket, and means associated with each of the upper and lower body exercising assemblies for permitting the selective rotation of the upper and lower driving sprockets in isolation or in conjunction with each other, such that rotation of the upper driving sprocket is not imparted to the lower driving sprocket and rotation of the lower driving sprocket is not imparted to the upper driving sprocket.

The means for connecting the upper driven sprocket to the energy receiving means preferably includes a first sprocket connected to the upper driven sprocket for rotation therewith and a second sprocket operatively connected, preferably by means of an endless chain, to the first sprocket for rotation therewith. The second sprocket is connected to the energy receiving means so that rotation of the upper driven sprocket is transferred through the first and second sprockets to the energy receiving means. There are preferably tensioning sprockets on the endless chain between the first and second sprockets.

The selective rotation permitting means may be provided by one-directional ratcheted sprockets in the position of the upper and lower driven sprockets. Alternatively, the one-directional ratcheted sprockets may be in the position of the first and second sprockets.

Preferably, the upper body exercising assembly is pivotally and slidably attached to the frame of the lower body exercising assembly to permit the position of the upper body exercising assembly to be selectively adjusted relative to the lower body exercising assembly. In addition, the crank arms of the rotary hand members and rotary foot pedals may be telescoping members to permit the adjustment of the radius of the circle through which the hands and feet move. All chains and sprockets are preferably guarded for safety.

BRIEF DESCRIPTION OF THE DRAWINGS

The present invention can be better understood by reference to the drawings in which.

DETAILED DESCRIPTION OF THE PREFERRED EMBODIMENT

Figure 1:
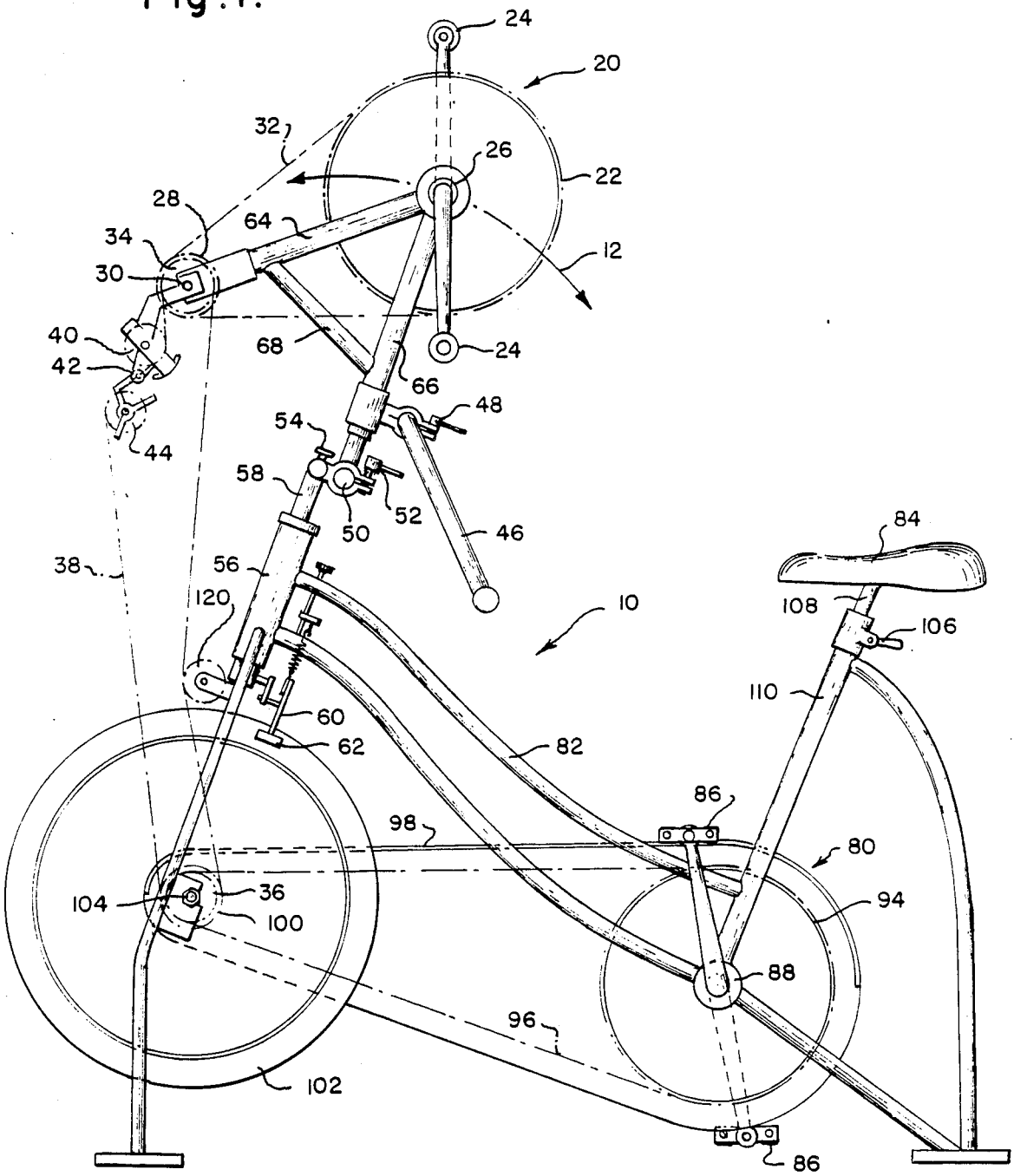
FIG. 1 is a side elevation view of the preferred embodiment of the exercise apparatus of the present invention.
Figure 2:
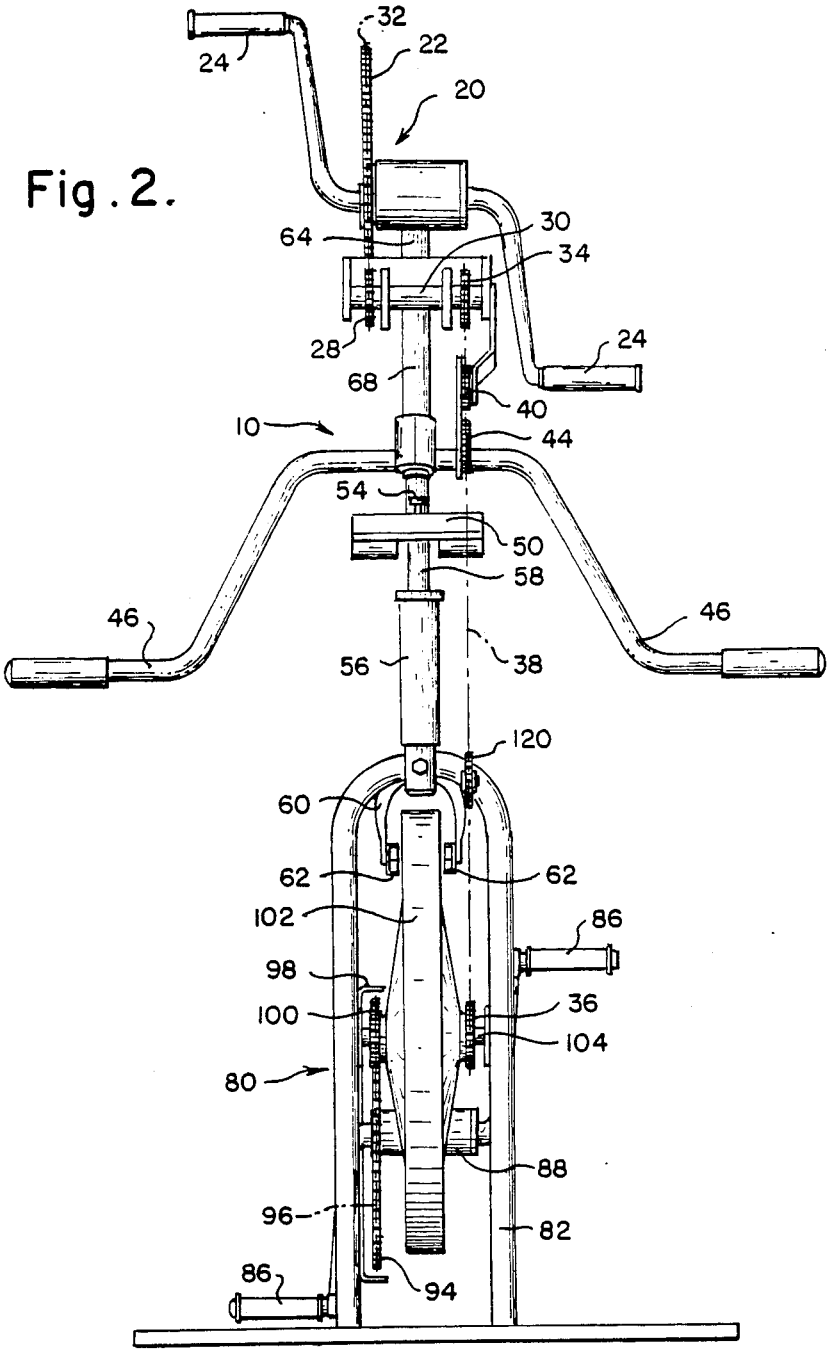
FIG. 2 is a front elevation view of the exercise apparatus of FIG. 1.

FIGS. 1 and 2 illustrate the preferred embodiment of the exercise apparatus 10 of the present invention. The exercise apparatus 10 provides a total integrated exercise unit or an attachment to a standard exercise bicycle which affords the same aerobic and anaerobic exercise to the upper body as a conventional exercise bicycle provides for the lower body through resistance. The unique feature of the operation of the exercising apparatus 10 is the independence of upper body and lower body motion with the option of providing both motions simultaneously. In addition, the adjustability of the apparatus 10 to all body types through the pivoting and linear adjustments designed into the upper body exercise assembly and such assemblies' integration with the main frame of the lower body exercising assembly provide unique advantages over prior art exercising equipment.

Referring to FIG. 1, the exercise apparatus 10 includes an upper body assembly 20 and a lower body assembly 80. The upper body assembly 20 includes an upper driving sprocket 22 mounted on axle 26. Rotary handle members 24 for rotating the upper driving sprocket 22 are mounted on opposing ends of axle 26. A rigid member 64 joins axle 26 to another axle 30 on which an upper driven sprocket 28 is mounted. An endless transmission chain, or belt, 32 operatively connects the upper driving sprocket 22 to the upper driven sprocket 28 so that the rotation of the upper driving sprocket 22 by means of the rotation of handle members 24 rotates upper driven sprocket 28.

The rotation of the upper driven sprocket 28 is transferred to the wheel 102 of the lower body exercising assembly 80 by means of a first connecting sprocket 34 mounted on one end of axle 30 opposite upper driven sprocket 28, an endless transmission chain, or belt, 38 and a second connecting sprocket 36 mounted on one end of axle 104.

The upper body exercising assembly 20 is mounted to the lower body exercising assembly 80 by means of a rigid member 66 and pivotal connection 50. A stabilizing brace 68 joins rigid member 66 to rigid member 64. Pivotal connection 50 is mounted to the upper end of an inner telescoping shaft 58 which slides linearly relative to outer telescoping shaft 56. By adjusting nut 54, the inner telescoping shaft 58 can be raised and lowered to selectively position the upper body assembly 20 relative to the lower body assembly 80. Similarly, by adjusting member 52, rigid member 66 can be pivoted about pivotal connection 50 to selectively move the upper body assembly 20 towards or away from the user, through an arc 12 as shown in FIG. 1. The linear and pivotal adjustment features permit exercise apparatus 10 to be adjusted for any body type. In addition, seat 84 of lower body exercising assembly 80 is mounted on an inner telescoping shaft 108 which can be raised and lowered linearly within an outer shaft 110 to selectively adjust the height of seat 84. The crank arms connecting rotary hand members 24 and rotary foot pedals 86 to the upper and lower driving sprockets 28 and 100, respectively, may be telescoping arms to permit the user to selectively increase or decrease the radius of rotation of the hand or foot movement. The radius can be adjusted to permit full extension of the arms and/or legs. The exercise apparatus 10 may also be elevated somewhat to permit the increase in the foot pedal crank arms.

Tensioning sprockets 40 and 44 and spring 42 are provided to tension chain 38 to accommodate any position of upper body assembly 20. An idler 120 is also provided to prevent chain 38 from contacting shaft 56 when the upper body assembly 20 is moved towards the user. During both the pivoting and raising and lowering of the upper body assembly 20, chain 38 will remain tight because of tensioning sprockets 40 and 44.

Lower body exercising assembly 80 includes frame 82, seat 84, lower driving sprocket 94 and rotary foot pedals 86 mounted on each end of axle 88 to rotate lower driving sprocket 94. Referring to FIG. 2, lower driving sprocket 94 is mounted on one end of axle 88.

An endless transmission chain, or belt, 96 operatively connects lower driving sprocket 94 to lower driven sprocket 100. Lower driven sprocket 100 is mounted on one end of axle 104, opposite the second connecting sprocket 36. Rotation of lower driving sprocket 94 by means of the rotary foot pedals 86 is transferred through chain 96 to lower driven sprocket 100 and in turn to wheel 102. A guard 98 protects chain 96. Similar guards may protect all chains and sprockets of the exercise apparatus 10. Although wheel 102 is preferred, any suitable means for receiving energy from the rotation of the upper and lower driven sprockets, 28 and 100, respectively, may be employed.

In the preferred embodiment, upper and lower driven sprockets 28, 100 are one-directional ratcheted sprockets which permit the upper and lower driving sprockets 22 and 94, respectively, to be selectively rotated in isolation or in conjunction with each other. Thus, rotation of the upper driving sprocket 28 is not imparted to the lower driving sprocket 94 and rotation of the lower driving sprocket 94 is not imparted to the upper driving sprocket 28.

The ratcheted sprockets are of the commercially available variety used in free wheel multiple co-axial sprocketed racing bicycles and operate to permit rotation of the upper body and lower driven sprockets 28, 100 only if the outside shell of the ratcheted sprocket is rotated by the respective chains 32, 96. Thus, by rotating handle members 24 to rotate upper driving sprocket 22, chain 32 rotates upper driven sprocket 28 which in turn rotates the first and second connecting sprockets 34 and 36 through axle 30 and chain 38. The second connecting sprocket 36 in turn rotates axle 104 and wheel 102 but it will not rotate the lower driven sprocket 100. Therefore, chain 96, lower driving sprocket 94, and rotary foot pedals 86 will not rotate.

Similarly, by rotating rotary foot pedals 86 to rotate lower driving sprocket 94 and lower driven sprocket 100 via chain 96, the axle 104, wheel 102, second connecting sprocket 36 and first connecting sprocket 34 will rotate. Upper driven sprocket 38, however, will not rotate due to the one-directional features of the ratcheted sprocket. The ratched sprockets provide added safety by permitting either or both the hands or feet to be stopped at will. The associated hand and foot pedals stop also due to the one-directional sprockets.

In an alternative embodiment, the first and second connecting sprockets, 34 and 36, respectively, may be one-directional ratcheted sprockets instead of, or in addition to, the upper and lower driven sprockets, 28 and 100. To keep chain 38 stationary when only the lower body assembly is used, the upper and lower driven sprockets 28 and 100 and the second connecting sprocket 36 may be one-directional ratcheted sprockets.

Optional adjustable handle bars 46 may be provided for use when only the lower body exercising assembly 80 is used. The handle bars 46 permit the user to assume the same posture he or she would assume if riding a bicycle. Adjustment member 48 permits the selective positioning of the handle bars 46.

Additional vertical movement of handle bars 46 can be achieved by loosening nut 54 to raise and lower the telescoping shaft 58. Nut 54 is tightened when the desired position is reached.

Resistance is applied to wheel 102 by means of resistance loading means, or calipers, 60 having brake pads 62. By adjusting the amount of resistance the ease with which the upper and lower driving sprockets, 22 and 94, may be rotated can be selectively altered. The resistance loading means may be any suitable device, such as rollers, fans or electromagnetic means. Any suitable known means may be used to monitor the rotation of the wheel 102 to determine the work or distance equivalents of the rotation of upper and lower driving sprockets 22 and 94. The mutual resistance provided by the resistance loading means on wheel 102 permits the combined work of two muscle groups to be monitored.

The exercise apparatus 10 permits the upper and lower body exercising assemblies 20 and 80, respectively, to be used in conjunction or in isolation, at the user's option. The most benefit to the user will be realized when both upper and lower body motions are used to drive the resistance against wheel 102 simultaneously. In an alternative embodiment of exercise apparatus 10, means can be provided to permit the hands and feet to be rotated at different speeds. The differential rotation can be accomplished by replacing the one-directional ratcheted sprockets with any suitable differential device, such as a gear shifter and derailer having fixed gear ratios as used on multiple sprocketed racing bicycles, a tapered pulley and belt so that the radius of the pulley replacing ratcheted sprocket would be conical in shape, thus acting as a variable radius, multiple pulleys of various fixed diameters on a common shaft, or an internal planetary gear box.

What is claimed is

1. An upper body exercise assembly for attachment to a stationary lower body assembly wherein said lower body exercise assembly includes a lower driving sprocket, means for rotating said lower driving sprocket, a lower driven sprocket operatively connected to said lower driving sprocket for rotation therewith and means connected to said lower driven sprocket for receiving energy from the rotation of said lower driven sprocket, said upper body exercising assembly comprising:

an upper driving sprocket;

means for rotating said upper driving sprocket;

an upper driven sprocket operatively connected to said upper driving sprocket for rotation therewith;

means for operatively connecting said upper driving and driven sprockets;

means for connecting said upper driven sprocket to said energy receiving means so that said energy receiving means receives energy from the rotation of said upper driven sprocket; and means associated with each of said upper and lower body exercising assemblies for permitting the selective rotation of said upper and lower driving sprockets in isolation or in conjunction with each other, such that rotation of said upper driving sprocket is not imparted to said lower driving sprocket and rotation of said lower driving sprocket is not imparted to said upper driving sprocket.

2. The upper body exercising assembly recited in claim 1 wherein said selective rotation permitting means is provided by a one-directional ratcheted sprocket in the position of said upper driven sprocket and another one-directional ratcheted sprocket in the position of said lower driven sprocket.

3. The upper body exercising assembly recited in claim 1 wherein said connecting means comprises:

a first sprocket connected to said upper driven sprocket for rotation therewith;

a second sprocket operatively connected to said first sprocket for rotation therewith, said second sprocket being so connected to said energy receiving means that rotation of said upper driven sprocket is transferred through said first and second sprockets to said energy receiving means; and means for operatively connecting said first and second sprockets.

4. The upper body exercising assembly recited in claim 3 wherein said selective rotation permitting means is provided by a one-directional ratcheted sprocket in the position of said first sprocket and another one-directional ratcheted sprocket in the position of said second sprocket.

5. The upper body exercising assembly recited in claim 3 wherein said selective rotation permitting means is provided by a first one-directional ratcheted sprocket in the position of said upper driven sprocket, a second one-directional ratcheted sprocket in the position of said lower driven sprocket and a third one-directional ratcheted sprocket in the position of said second sprocket.

6. The upper body exercising assembly recited in claim 3 wherein said operative connecting means are endless chains.

7. The upper body exercising assembly recited in claim 6 further comprising means for tensioning said endless chain operatively connecting said first and second sprockets.

8. The upper body exercising assembly recited in claim 1 wherein said operative connecting means is an endless chain.

9. The upper body exercising assembly recited in claim 1 wherein said energy receiving means is a wheel rotatably mounted to said lower body exercise assembly, said wheel being rotatable by the independent or joint rotation of said lower driven sprocket and said upper driven sprocket.

10. The upper body exercising assembly recited in claim 1 wherein said means for rotating said upper driving sprocket are rotary hand members.

11. The upper body assembly recited in claim 1 further comprising means for adjusting the position of said upper body exercising assembly relative to said lower body exercising assembly.

12. The upper body exercising assembly recited in claim 11 wherein said lower body exercising assembly includes a frame to which said upper body exercising assembly is pivotally mounted to selectively adjust the position of said upper body exercising assembly relative to said lower body exercising assembly.

13. The upper body exercising assembly recited in claim 11 wherein said lower body exercising assembly includes a frame to which said upper body exercising assembly is slidably mounted to selectively raise and lower said upper body exercising assembly relative to said lower body exercising assembly.

14. The upper body exercising assembly recited in claim 1 further comprising means for tensioning said connecting means.

15. The upper body exercising assembly recited in claim 1 wherein said lower body exercising assembly includes a resistance loading means associated with said energy receiving means for selectively altering the ease with which said upper and lower driving sprockets may be rotated.

16. A stationary exercise apparatus comprising a lower body exercising assembly and an upper body exercising assembly wherein said lower body assembly comprises:

a frame;

a seat mounted on said frame;

a lower driving sprocket;

means for rotating said lower driving sprocket;

a lower driven sprocket operatively connected to said lower driving sprocket for rotation therewith;

means for operatively connecting said lower driving and driven sprockets;

means connected to said lower driven sprocket for receiving energy from the rotation of said lower driven sprocket; and said upper body assembly being adjustably attached to said frame so that the position of said upper body assembly relative to said lower body assembly is selectively adjustable and said upper body assembly comprising:

an upper driving sprocket;

means for rotating said upper driving sprocket;

an upper driven sprocket operatively connected to said upper driving sprocket for rotation therewith;

means for operatively connecting said upper driving and driven sprockets;

means for connecting said upper driven sprocket to said energy receiving means so that said energy receiving means receives energy from the rotation of said upper driven sprocket; and means associated with each of said upper and lower body exercising assemblies for permitting the selective rotation of said upper and lower driving sprockets in isolation or in conjunction with each other, such that rotation of said upper driving sprocket is not imparted to said lower driving sprocket and rotation of said lower driving sprocket is not imparted to said upper driving sprocket.

17. The exercise apparatus recited in claim 16 wherein said means for connecting said upper driven sprocket to said energy receiving means comprises:

a first sprocket connected to said upper driven sprocket so that rotation of said upper driven sprocket rotates said first sprocket; and a second sprocket operatively connected to said first sprocket so that rotation of said first sprocket rotates said second sprocket, said second sprocket being so connected to said energy receiving means that rotation of said upper driven sprocket is transferred through said first and second sprockets to said energy receiving means; and means for operatively connecting said first and second sprockets.

18. The exercise apparatus recited in claim 17 wherein said upper body assembly is pivotally attached to said frame to selectively move said upper body assembly toward and away from said seat.

19. The exercise apparatus recited in claim 17 wherein said upper body assembly is slidably attached to said frame to selectively raise and lower said upper body assembly relative to said lower body assembly.

20. The exercise apparatus recited in claim 17 wherein said means for operatively connecting said first and second sprockets is an endless chain.

21. The exercise apparatus recited in claim 20 further comprising a plurality of tensioning sprockets associated with said endless chain.

22. The exercise apparatus recited in claim 17 wherein said selective rotation permitting means is provided by a one-directional ratcheted sprocket in the position of said first sprocket and another one-directional ratcheted sprocket in the position of said second sprocket.

23. The exercise apparatus recited in claim 16 wherein said selective rotation permitting means is provided by a one-directional ratcheted sprocket in the position of said upper driven sprocket and another one-directional ratcheted sprocket in the position of said lower driven sprocket.

24. An upper body exercise assembly for attachment to a stationary lower body exercise assembly wherein said lower body exercise assembly includes a lower driving sprocket, means for rotating said lower driving sprocket, a lower driven sprocket operatively connected to said lower driving sprocket for rotation therewith and means connected to said lower driven sprocket for receiving energy from the rotation of said lower driven sprocket, said upper body exercising assembly comprising:

an upper driving sprocket;

means for rotating said upper driving sprocket;

an upper driving sprocket operatively connected to said upper driving sprocket for rotation therewith;

means for operatively connecting said upper driving and driven sprockets;

means for connecting said upper driven sprocket to said energy receiving means so that said energy receiving means receives energy from the rotation of said upper driven sprocket, said energy receiving means being positioned intermediate said upper driven sprocket and said lower driven sprocket; and means associated with each of said upper and lower body exercising assemblies positioned intermediate said upper and lower driving sprockets for permitting the selective rotation of said upper and lower driving sprockets in isolation or in conjunction with each other, such that rotation of said upper driving sprocket is not imparted to said lower driving sprocket and rotation of said lower driving sprocket is not imparted to said upper driving sprocket.

25. A stationary exercise apparatus comprising:

a lower body exercising assembly and an upper body exercising assembly wherein said lower body assembly comprises:

a frame;

a seat mounted on said frame;

a lower driving sprocket;

means for rotating said lower driving sprocket;

a lower driven sprocket operatively connected to said lower driving sprocket for rotation therewith;

means for operatively connecting said lower driving and driven sprockets;

means connected to said lower driven sprocket for receiving energy from the rotation of said lower driven sprocket; and said upper body assembly being adjustably attached to said frame so that the position of said upper body assembly relative to said lower body assembly is selectively adjustable and said upper body assembly comprising:

an upper driving sprocket;

means for rotating said upper driving sprocket;

an upper driven sprocket operatively connected to said upper driving sprocket for rotation therewith;

means for operatively connecting said upper driving and driven sprockets;

means for connecting said upper driven sprocket to said energy receiving means so that said energy receiving means receives energy from the rotation of said upper driven sprocket, said energy receiving means being positioned intermediate said upper driven sprocket and said lower driven sprocket; and means associated with each of said upper and lower body exercising assemblies positioned intermediate said upper and lower driving sprockets for permitting the selective rotation of said upper and lower driving sprockets in isolation or in conjunction with each other, such that the rotation of said upper driving sprocket is not imparted to said lower driving sprocket and rotation of said lower driving sprocket is not imparted to said upper driving sprocket.

* * * * *

UNITED STATES PATENT AND TRADEMARK OFFICE

CERTIFICATE OF CORRECTION

PATENT NO. : 4,705,269

DATED : November 10, 1987

INVENTOR(S) : William M. DeBoer et al.

It is certified that error appears in the above-identified patent and that said Letters Patent is hereby corrected as shown below:

Col. 5, line 67, after "body" insert --exercise--.
Col. 7, line 35, after "comprising" insert --:--.
Col. 8, line 59, delete "driving" and substitute therefor --driven--.

Signed and Sealed this

First Day of March, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,705,269

DATED : November 10, 1987

INVENTOR(S) : William DeBoer et al.

It is certified that error appears in the above-identified patent and that said Letters Patent is hereby corrected as shown below:

Col. 4, line 18, delete "28" and substitute therefor --22--; line 18, also delete "100" and substitute therefor --94--; line 56, delete "28" and substitute therefor --22--; and line 59, delete "28" and substitute therefor --22--.

Signed and Sealed this

Thirty-first Day of May, 1988

*Attest:*

*Attesting Officer*

DONALD J. QUIGG

*Commissioner of Patents and Trademarks*